United States Patent [19]

Wildmoser

[11] Patent Number: 4,628,668

[45] Date of Patent: Dec. 16, 1986

[54] UNIT LOAD WRAPPING WITH CONTROLLED WRAP TENSIONING

[75] Inventor: Martin M. Wildmoser, Staten Island, N.Y.

[73] Assignee: Bemis Company, Inc., Minneapolis, Minn.

[21] Appl. No.: 707,522

[22] Filed: Mar. 1, 1985

Related U.S. Application Data

[63] Continuation of Ser. No. 368,912, Apr. 16, 1982, abandoned.

[51] Int. Cl.[4] ..... B65B 11/08

[52] U.S. Cl. ..... 53/399; 53/441; 53/556; 53/586

[58] Field of Search ..... 26/71, 106; 264/288.4; 53/441, 399, 466, 556, 586, 228

[56] References Cited

U.S. PATENT DOCUMENTS

| | | | |
|---|---|---|---|
| 1,926,457 | 9/1933 | Shields | 26/106 X |
| 1,982,720 | 12/1934 | Woodhead | 26/106 X |
| 3,561,134 | 2/1971 | Kruckels | 26/106 X |
| 3,589,091 | 6/1971 | Cloud | 53/586 X |
| 3,672,116 | 6/1972 | Ingmarson | 53/586 X |
| 3,866,389 | 2/1975 | Elsner | 53/553 X |
| 4,302,920 | 12/1981 | Lancaster | 53/441 X |
| 4,313,288 | 2/1982 | Tassi | 53/553 X |
| 4,413,463 | 11/1983 | Lancaster | 53/586 X |

FOREIGN PATENT DOCUMENTS

| | | | |
|---|---|---|---|
| 693645 | 7/1940 | Fed. Rep. of Germany | 26/71 |
| 2750780 | 5/1979 | Fed. Rep. of Germany | 53/581 |
| 2281275 | 4/1976 | France | 53/556 |

*Primary Examiner*—John Sipos

*Attorney, Agent, or Firm*—Samuelson & Jacob

[57] ABSTRACT

Apparatus and method for wrapping a resiliently stretchable film wrap around a group of articles stacked on a pallet, with the film wrap tensioned to a desired tension, by feeding the film wrap along a feed path from supply rolls to a wrapping station, with tension rollers placed serially along the feed path such that the film wrap is coupled for movement with the surface of each tension roller, the tension rollers being driven so that the surface speeds of the serially located roller surfaces differ from one another in order to stretch and tension the film wrap to a given tension, and the stretched and tensioned film wrap being applied to the stacked articles at a rate relative to the advancement of the film wrap from the tension rollers so as to attain the desired tension in the applied film wrap while limiting the magnitude of forces exerted upon the unit load by the tensioned film wrap.

13 Claims, 10 Drawing Figures

UNIT LOAD WRAPPING WITH CONTROLLED WRAP TENSIONING

This application is a continuation of application Ser. No. 368,912, filed Apr. 16, 1982 now abandoned.

The present invention relates generally to packaging methods and apparatus and pertains, more specifically, to wrapping methods and wrapping machines of the type which place a film wrap around a group of articles, such as cases or cartons stacked upon a pallet, usually moved through a wrapping station in the machine.

Packaging machines of the type in which a film wrap of synthetic resin material is placed around a group of articles, such as cases or cartons stacked upon a pallet and forming a unit load, are well known. In such machines, a palletized stack usually is moved along a conveyor to pass through a wrapping station where a thermoplastic film wrap is drawn into a sleeve around the four sides of the stack and is secured by a heat seal along the confronting edges of the sleeve. In order to assure a tight fit around the stacked articles, and thus maintain the integrity of the wrapped stack, the film wrap in the completed sleeve usually is placed under tension. In some instances the desired tension is attained by shrinking the film wrap with heat applied subsequent to the wrapping operation. In other arrangements, the film wrap is tensioned mechanically as the film wrap is drawn over the stack, with sufficient force applied to that portion of the film wrap which extends between the stack and the wrapping mechanism to tension the film wrap.

Those films which shrink in response to the application of heat generally are more costly than some thermoplastic films which do not shrink, but otherwise are suitable for film wrapping operations. Further, the application of heat to a wrapped stack requires additional time, equipment and added energy input. Moreover, the heat itself may be undesirable in the wrapping of particular articles which should not be heated. Hence, it would be more economical and, in some instances, imperative to accomplish the desired tensioned film wrap sleeve without resorting to heat shrinking.

In mechanical tensioning of the film wrap, care must be taken to assure that the tensioning forces transmitted to the unit load being wrapped do not distort or topple the stack of grouped articles, especially where the stack is not stable enough to withstand high tensioning forces. In addition, the forces exerted by the film wrap upon the unit load as the unit load is being wrapped should not impede the rate at which the film wrap is applied to the unit load; that is, relative movement between the unit load and the wrap-applying apparatus should continue without interference from the tensioning forces. Further, the film wrap should be tensioned along the entire periphery of the wrapped unit load, with the amount of tension being essentially uniform in each leg of a film wrap sleeve which extends around a rectangular or other multi-sided stack.

It has been suggested that the film wrap can be pretensioned to a relatively high degree prior to applying such pretensioned film wrap to a unit load, as disclosed in U.S. Pat. No. 4,302,920. However, such pre-tensioning is attained by forces exerted upon the film wrap by the unit load through relative movement between the unit load and the film wrap applying apparatus. Thus, forces of relatively high magnitude are transmitted to the unit load.

It is an object of the present invention to provide wrapping apparatus and method in which a film wrap is tensioned without excessive forces resulting from contact between the film wrap and a group of articles to be wrapped, during the wrapping operation.

Another object of the invention is to provide wrapping apparatus and method in which a film wrap of resilient thermoplastic material is tensioned to a given tension somewhat greater than the tension desired in a completed wrapped unit load as the film wrap is moved along a feed path from a supply roll to a wrapping station, and prior to application of the film wrap to the unit load being wrapped, and then applied to the unit load to attain the desired tension.

Still another object of the invention is to provide wrapping apparatus and method as described and in which the amount of tension placed in the film wrap is selected with ease.

Yet another object of the invention is to provide wrapping apparatus of the type described and which employs a simple yet effective mechanism, easily adapted to current wrapping machine configurations, for introducing, in a positive manner, the desired tension in the film wrap, without excessive forces arising out of contact with the stack of articles to be wrapped.

A further object of the invention is to provide apparatus and method as described and which enable versatility in adapting to different film wraps and various articles to be wrapped.

A still further object of the invention is to provide apparatus and method as described and which enable more positive control over the film wrap for more effective and reliable wrapping operations.

Still a further object of the invention is to provide apparatus and method as described and which enable a more uniform tension throughout the length of the applied film wrap.

Yet a further object of the invention is to provide a wrapping apparatus of the type described and which enables relatively trouble-free and consistent performance over a long service life.

The above objects, as well as still further objects and advantages, are attained by the present invention which may be described briefly as providing apparatus and method for wrapping a unit load at a wrapping station with a resiliently stretchable film wrap advanced along a feed path from a supply of such film wrap to the wrapping station, with the film wrap tensioned to a desired tension, while limiting the magnitude of forces exerted upon the unit load by the film wrap during wrapping, the apparatus and method comprising: means for and the step of stretching the film wrap as the film wrap is advanced along the feed path so as to elongate and tension the film wrap to a given tension; means for and the step of immediately thereafter applying the previously elongated and tensioned film wrap to the unit load at a given rate of application; and means for and the step of advancing the previously elongated and tensioned film wrap at a rate of advancement different from the given rate of application so as to attain the desired tension in the applied film wrap while limiting the magnitude of the forces exerted upon the unit load by the tensioned film wrap.

The invention will be more fully understood, while still further objects and advantages will become apparent, in the following detailed description of preferred embodiments of the invention illustrated in the accompanying drawing, in which.

Figures 1, 2, 3, 4, 5:
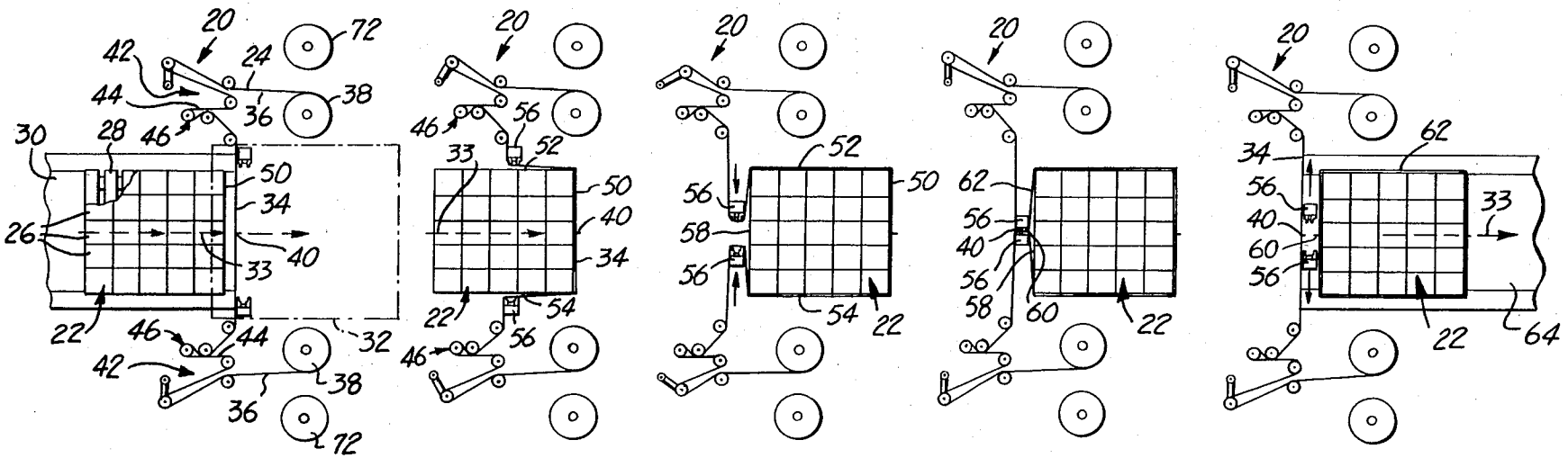
FIGS. 1 through 5 are diagrammatic illustrations showing the sequence of operations in a method of the invention performed by a wrapping machine constructed in accordance with the invention.

Referring now to the drawing, and especially to FIGS. 1 through 5 thereof, a wrapping machine constructed in accordance with the invention and the steps of the method of the invention are illustrated diagrammatically in connection with a machine 20 shown wrapping a unit load 22 with a film wrap 24.

As seen in FIG. 1, unit load 22, which in this instance is a group of articles in the form of cartons 26 stacked upon a pallet 28, is moved by an infeed conveyor 30 toward a wrapping station 32 of machine 20. At the wrapping station 32, film wrap 24 is stretched across the path of travel 33 of unit load 22 and supported there to establish a curtain 34 which will intercept the unit load 22 as the unit load is advanced along the path of travel 33. Film wrap 24 is a resilient thermoplastic synthetic resin material, such as polyethylene, and curtain 34 has been established by feeding film wrap 24 from indeterminate lengths 36 thereof stored on supply rolls 38 to the wrapping station 32 where the ends of the indeterminate lengths 36 are joined, as by heat sealing or welding, at a seam 40, as will be explained in greater detail below. Suffice it to say at this juncture that feed means 42 are provided to enable the advance of film wrap 24 along feed paths 44, and each feed means 42 includes tensioning means 46 which places a given tension in film wrap 24 as each length of film wrap is advanced along a feed path 44, and curtain 34 is appropriately tensioned.

In FIG. 2, the unit load 22 is seen to have been advanced into curtain 34 such that the first side 50 of unit load 22 is engaged by tensioned film wrap. Further film wrap has been advanced and tensioned to begin wrapping the second and third sides 52 and 54, respectively, of unit load 22.

In FIG. 3, the unit load 22 has reached a location where forward movement of the unit load 22 is discontinued and a pair of opposed jaws 56 move inwardly toward one another to complete the application of tensioned film wrap to the fourth side 58 of unit load 22, as seen in FIG. 4. Jaws 56 are urged toward one another and heat is applied to the film wrap clamped between the jaws 56 to sever the film wrap and to complete two seals, or welds, spaced apart from one another, in a manner now well known in wrapping machines, so as to establish a seam 60, which completes a sleeve 62 wrapped around the unit load 22, and to form the seam 40, thereby establishing another curtain 34 for a subsequent unit load.

As seen in FIG. 5, the lengths of film wrap 24 have been severed between seams 60 and 40 and unit load 22 again is advanced along path of travel 33, now by a discharge conveyor 64, unit load 22 now being wrapped with a suitably tensioned sleeve 62 of film wrap. Jaws 56 are retracted, leaving curtain 34 extending across the path of travel 33 of a subsequent unit load.

Figure 6:
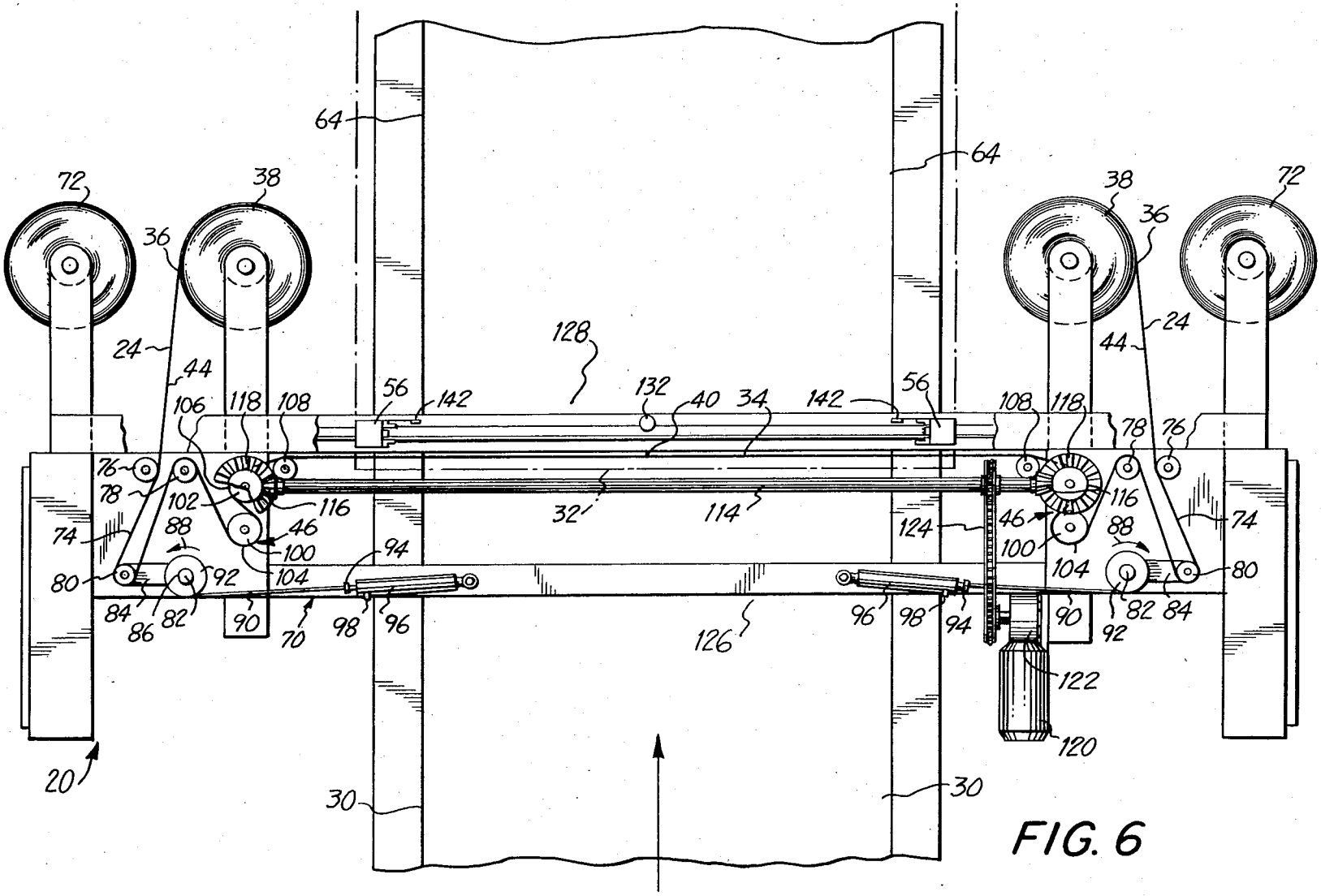
FIG. 6 is a plan view of the wrapping station of the machine.
Figure 7:
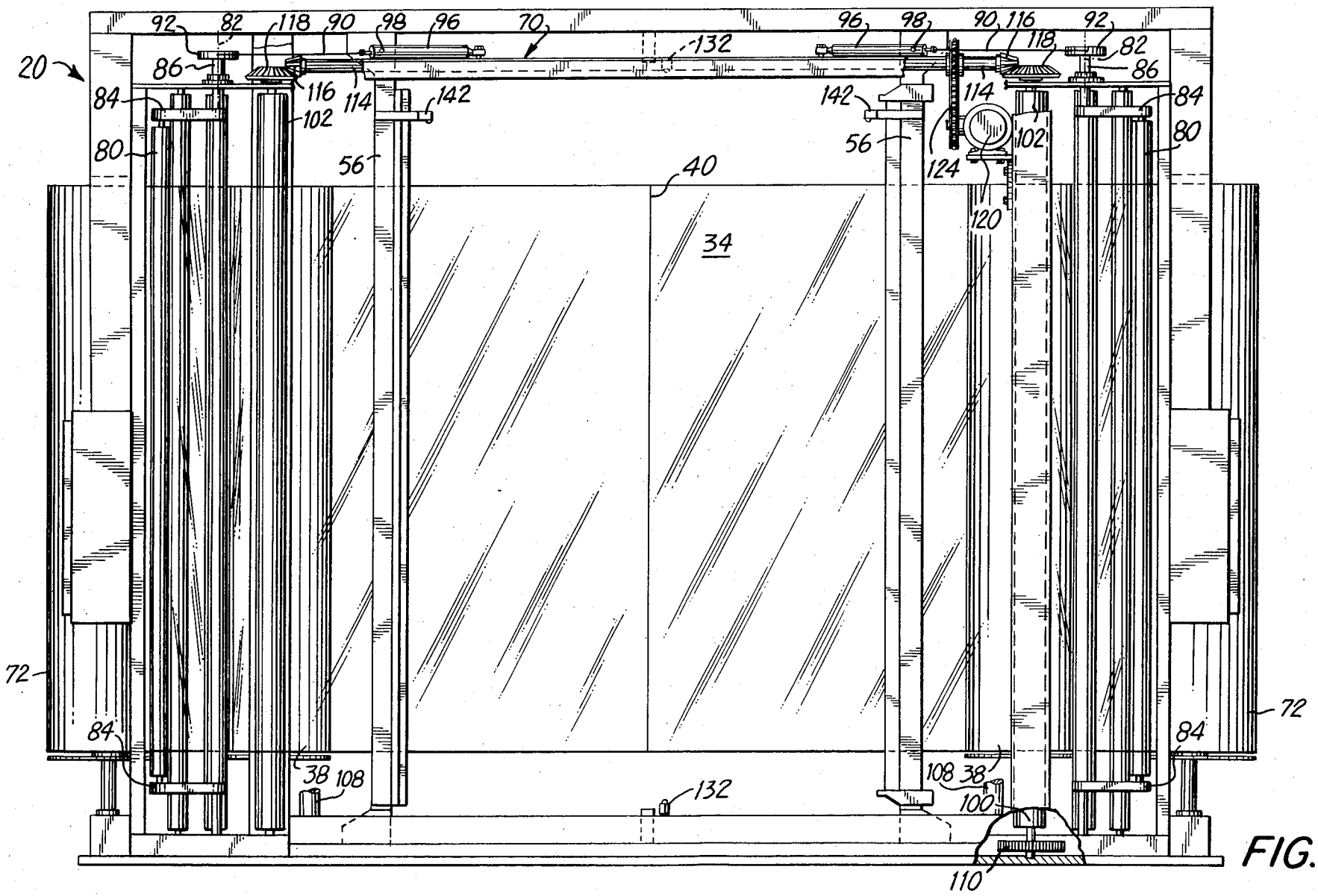
FIG. 7 is a front elevational view of the wrapping station of the machine.

Turning now to FIGS. 6 and 7, machine 20 has a frame 70 upon which supply rolls 38 are mounted. In the illustrated embodiment, optional auxiliary supply rolls 72 also are mounted on frame 70 and carry a reserve supply which can be threaded into machine 20 when primary supply rolls 38 are exhausted. Film wrap 24 is drawn from each supply roll 38 and held in a supply loop 74, which extends between idler rollers 76 and 78, by a dancer roller 80 mounted upon frame 70 for pivotal movement about a vertical axis 82 by means of dancer arms 84 and dancer shaft 86. Each dancer shaft 86 is biased in the direction of arrow 88, as seen in FIG. 6, by a cable 90, one end of which is wrapped around a drum 92 affixed to dancer shaft 86 and the other end of which is connected to the piston rod 94 of an air cylinder 96 carried by frame 70. The pressure of the air supplied to air cylinder 96 at air inlet 98 then determines the force with which each dancer shaft 86, and each dancer roller 80, is biased in the direction of each corresponding arrow 88. Such an arrangement enables the biasing force to be constant, regardless of the angular position of the dancer arms 84.

As described above in connection with FIGS. 1 through 5, the feed arrangement for feeding film wrap 24 along feed paths 44 further includes tensioning means 46 located along each feed path 44 downstream of supply roll 38 and supply loop 74; that is, between the supply roll 38 and the wrapping station 32. As now seen in FIGS. 6 and 7, tensioning means 46 includes a first tension roller 100 mounted upon frame 70 for rotation on a vertical axis and a second tension roller 102 similarly mounted for rotation on the frame 70 adjacent the first tension roller 100 and serially downstream of first tension roller 100, at each side of the wrapping station 32. Film wrap 24 is threaded first around a portion of the outer surface 104 of tension roller 100, then around a portion of the outer surface 106 of tension roller 102, and then passes over another idler roller 108 to be directed toward curtain 34 established by the lengths of feed wrap 24 advanced from each supply roll 38 and joined at seam 40, and supported by idler rollers 108 closely adjacent jaws 56.

Figure 8:
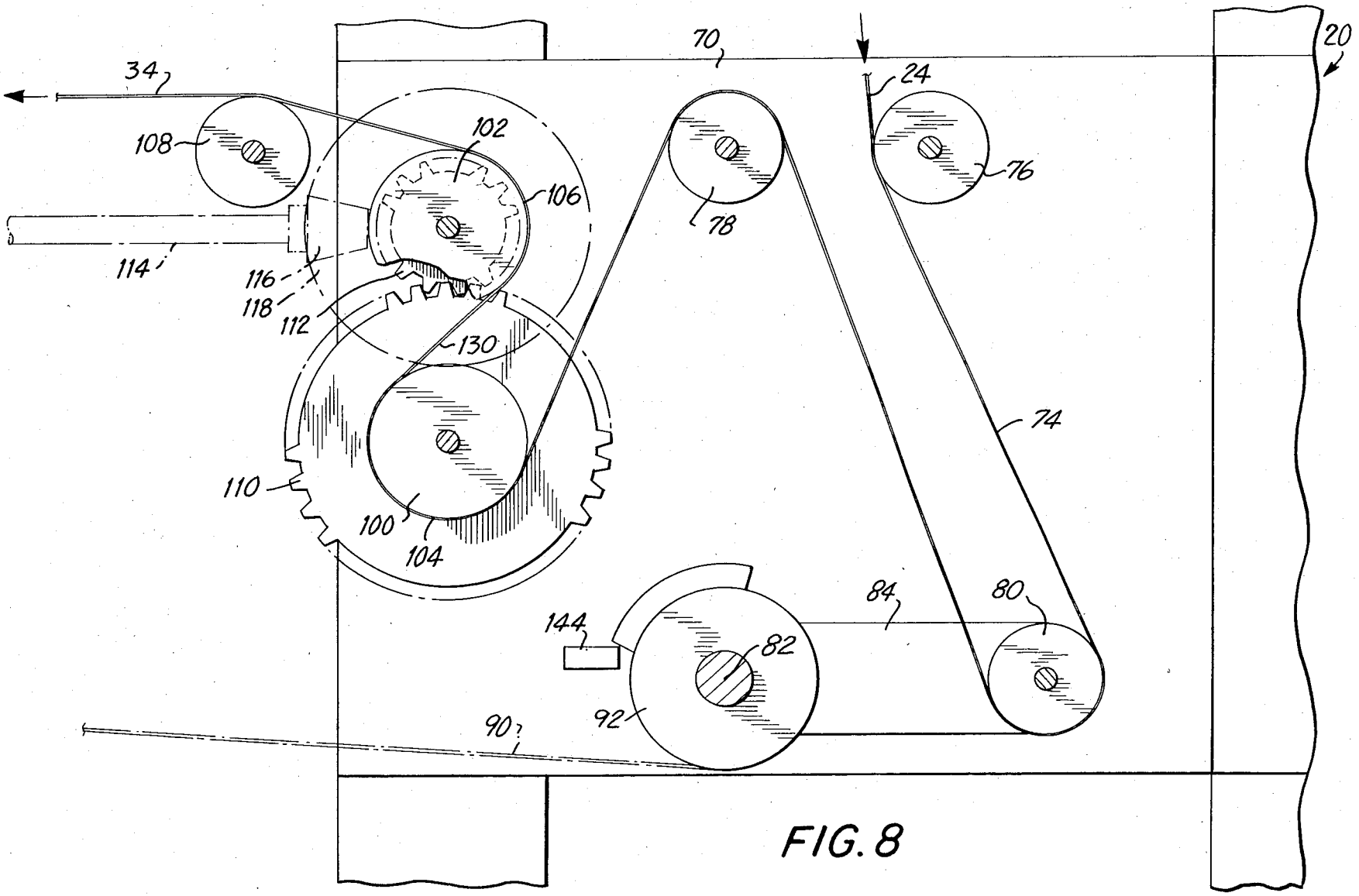
FIG. 8 is an enlarged fragmentary plan view of the film wrap tensioning mechanism of the machine.

As best seen in FIG. 8, as well as in FIGS. 6 and 7, tension rollers 100 and 102 are coupled for rotation with one another by a first spur gear 110 affixed to tension roller 100 adjacent the lower end thereof and meshed with a second spur gear 112 affixed to tension roller 102 adjacent the lower end thereof. A transverse shaft 114 is mounted upon frame 70 above the wrapping station 32 and carries pinion gears 116 which engage bevel gears 118 affixed to each second tension roller 102 adjacent the upper ends thereof so that all of the tension rollers 100 and 102 will rotate in synchronism. Alternately, spur gears 110 and 112 may be affixed to tension rollers 100 and 102 adjacent the upper ends of the rollers, as long as the spur gears are meshed to couple tension rollers 100 and 102 for rotation with one another.

Returning momentarily to FIGS. 6 and 7, an electricallyoperated motor 120 is mounted upon frame 70 and drives a gear drive 122 which, in turn, is coupled to transverse shaft 114 by means of a chain and sprocket drive train 124, for purposes which will be described below.

Bearing in mind the sequence of operations as explained earlier in connection with FIGS. 1 through 5, machine 20 assures that sleeve 62 is tensioned sufficiently to maintain the integrity of the group of cartons 26 in unit load 22 wrapped by the sleeve 62 without resorting to a heat-shrinkable film wrap and without relying upon excessive forces exerted between the unit load 22 itself and the film wrap 24 to stress the film wrap to the desired tension. Thus, first spur gear 110 has a pitch diameter larger than the pitch diameter of second spur gear 112 so that upon rotation of the tension rollers 100 and 102, second tension rollers 102 will rotate faster than first tension rollers 100. Since the diameter of outer surface 104 of each tension roller 100 is the same as the diameter of outer surface 106 of each tension roller 102, the surface speed of outer surface 106 will be greater than the surface speed of outer surface 104 and the film wrap 24, which is coupled for movement with outer surfaces 104 and 106 as the film wrap is advanced, will be stretched resiliently at portion 130, along the corresponding portion of each feed path 44 between the surfaces 104 and 106, to tension the film wrap. The degree of elongation and, hence, the amount of tension placed in the film wrap is a function of the ratio of the surface speeds of surfaces 104 and 106, which, in turn, is determined by the gear ratio of spur gears 110 and 112. By selecting the appropriate gear ratio, film wrap 24 is provided with a given amount of tension as the film wrap 24 is advanced and elongated by the tensioning means 46. The gear ratio may be selected by actually removing and replacing the spur gears 110 and 112 with gears of any selected ratio or by providing a suitable gear change mechanism.

Immediately after the resilient elongation and tensioning of the film wrap 24 by the tensioning means 46, the tensioned film wrap is applied to unit load 22. In this instance, the tensioned film wrap 24 is applied to the second and third sides 52 and 54, respectively, of unit load 22 by virtue of the forward movement of the unit load along the path of travel 33. Thus, the given rate of application of the film wrap 24 to the unit load 22 is determined by the rate of travel of the unit load 22 along infeed conveyor 30 and discharge conveyor 64. The magnitude of the forces exerted by the film wrap 24 upon the unit load 22 as film wrap 24 is applied along the second and third sides 52 and 54 is related to the rate at which tensioned film wrap 24 is advanced from tensioning means 46 to the unit load 22 at wrapping station 32 and the rate of travel of the unit load.

In conventional wrapping machines, film wrap is drawn from a supply by movement of the unit load, and a resistance in the feed path between the supply and the unit load tensions the film wrap. However, that tension is a direct result of forces between the unit load and the film wrap, and the requirement for greater tension results in higher magnitude forces placed upon the unit load by the film wrap as the film wrap is applied to the unit load. In the present arrangement, the film wrap 24 is stretched and tensioned by tensioning means 46 independent of the movement of unit load 22, and is then advanced by the operation of electric motor 120, while stretched and tensioned, at a rate of advancement independent of the rate of advancement of unit load 22. Thus, the difference between the rate of advancement of the film wrap 24 by tensioning means 46 and the rate of application of the film wrap 24 to the unit load 22, by virtue of the rate of travel of unit load 22 along path of travel 33, is employed to attain the desired tension in the applied film wrap while limiting the forces exerted upon the unit load by the tensioned film wrap, as now will be explained.

Figure 9:
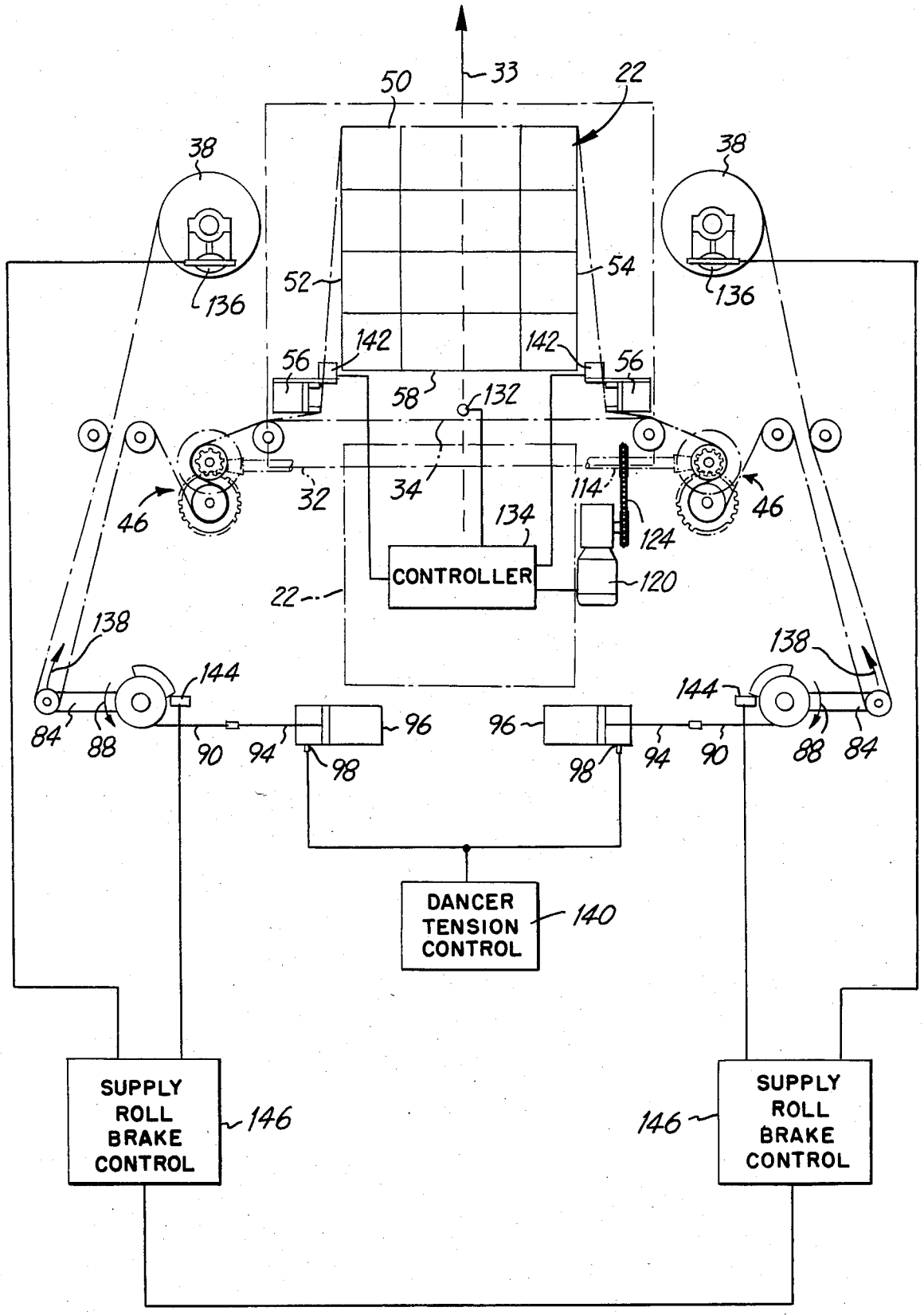
FIG. 9 is a schematic, partially diagrammatic plan view showing the control system of the machine.

Referring now to FIG. 9, as well as to each of the earlier figures, a control system is shown schematically for the operation of machine 20. Unit load 22 is shown in phantom in the position depicted diagrammatically in FIG. 1 and is shown in full lines in the position depicted diagrammatically in FIGS. 3 through 5. During movement of unit load 22 between these illustrated positions, the unit load 22 is intercepted by curtain 34 located adjacent the input end 126 of frame 70. At about the same time, the presence of the first side 50 of the unit load 22 at the wrapping station 32 is detected by detection means in the form of a unit load position detector switch shown as a photo-electric detector 132 which activates control means in the form of a controller 134 to actuate motor 120 at a first speed synchronized with the movement of unit load 22 along path of travel 33 toward the output end 128 of frame 70.

Such synchronization of the speed of motor 120 with the movement of unit load 22 is based upon the resilient stretch characteristics of the film wrap 24, the stability characteristics of the unit load, and the tension desired in the completed sleeve 62. The resilient stretch characteristics of film wrap 24 are such that once a length of the film wrap is elongated beyond the yield point of the material, it will tend to return toward its original shorter length, but with a finite delay in time. Thus, by stretching and tensioning film wrap 24 beyond the yield point and beyond the desired tension and then immediately advancing the over-stretched, over-tensioned film wrap from the tensioning means 46 to the moving unit load 22 at a rate of advancement greater than the rate of application of the film wrap to the unit load (that is, greater than the rate of travel of the unit load), the forces exerted upon the unit load by the tensioned film wrap will be limited, by virtue of the relaxation of the film wrap resulting from the difference between the rate of advancement and the rate of application of the film wrap, and by virtue of the delayed rate of return of the over-stretched film wrap toward its original length. Using currently available wrapping materials, the film wrap preferably is stretched to a total elongation of about 30 to 100 percent of its original length in order to elongate the material beyond its yield point and attain the desired result; however, elongation outside the preferred range may be appropriate in order to match the characteristics of particular film wrap materials and unit loads. Once the application of the film wrap is complete, the desired tension is attained by virtue of the fact that the applied film wrap tends to return toward its original length subsequent to completion of the application, thereby establishing the desired tension. Thus, the combination of over-stretching and over-tensioning the film wrap beyond the desired tension, and then immediately advancing the over-tensioned film wrap at a relative rate which enables relaxation of the film wrap, reduces the magnitude of forces exerted by the film wrap upon the unit load, and enables the attainment of the desired tension subsequent to the application of the film wrap to the unit load.

In order to assure the appropriate stretching and tensioning of film wrap 24 by tensioning means 46, a pre-tensioning means is associated with the advancement of film wrap from each supply roll 38. Thus, the free rotation of supply rolls 38 is resisted by a brake 136 associated with each supply roll so that as film wrap 24 is withdrawn from supply loops 74, the dancer arms 84 will rotate in the direction of arrows 138. During such rotation of the dancer arms 84, a constant biasing force is exerted on the dancer arms in the direction of arrows 88 so as to establish a predetermined amount of tension in the film wrap 24 being advanced to tensioning means 46. The predetermined amount of tension is determined by the magnitude of the air pressure in each air cylinder 96, which magnitude is controlled by a dancer tension control unit 140. Control unit 140 enables the selection of sufficient tension in the portion of film wrap 24 which extends between each supply loop 74 and the corresponding tensioning means 46 to assure that film wrap 24 will be coupled adequately with the outer surface 104 of tension roller 100 to enable tensioning means 46 to stretch further portion 130 of film wrap 24, as described above. Thus, stretched film wrap, now tensioned to a given tension in accordance with the ratio of the surface speeds of the tension rollers 100 and 102, is supplied to the unit load 22 in a positive manner, without excessive forces resulting from contact between the unit load 22 and the film wrap 24. Further, the relationship between the speed of advancement of the unit load 22 along path of travel 33 and the speed of travel of the film wrap 24 as it is fed to the unit load 22 from the tensioning means 46 (the speed of travel of the film wrap being determined by the surface speed of outer surface 106 of tension roller 102) is arranged such that any forces exerted upon the unit load 22 by the film wrap 24 as the unit load 22 proceeds through the wrapping station 32 are limited so as to retain the integrity of the unit load 22, even where the load may be somewhat unstable, as explained above, but still are of sufficient magnitude to maintain the film wrap coupled with outer surface 106 of tension roller 102 for advancement thereby.

Once the unit load 22 reaches the position shown in full lines in FIG. 9, fourth side 58 of unit load 22 passes beyond detector 132 and detector 132 operates controller 134 to discontinue movement of the unit load 22, and to commence inward movement of jaws 56, as described above in connection with FIGS. 3 and 4. Upon inward movement of jaws 56, further detection means in the form of load unit proximity detector switches 142 activate controller 134 to actuate motor 120 at a second speed, usually faster than the first speed described above, such that further film wrap 24 will be drawn from supply loops 74 and advanced to the unit load 22 at a rate coordinated with the rate of movement of jaws 56. In this instance, the rate of application of film wrap 24 to fourth side 58 is determined by the rate of travel of jaws 56, since the unit load 22 is stationary. The rate of advancement of the film wrap from tensioning means 46 to the jaws 56 is selected so as to relax the film wrap somewhat during application, thereby reducing the forces applied by the film wrap to the jaws 56, as well as to the unit load 22.

The withdrawal of further film wrap 24 from supply loops 74 will cause still further rotation of dancer arms 84 in the direction of arrows 138. Limit switches 144 operate supply roll brake controls 146 to control the supply roll brakes 136, enabling rotation of supply rolls 38 and the replenishment of supply loops 74 as the dancer arms 84 are returned to the position shown in FIG. 9 under the influence of the biasing force exerted by cables 90. Jaws 56 are retracted to the position shown in FIG. 9, all as further illustrated and described above in connection with FIGS. 4 and 5. The completed sleeve 62 is suitably tensioned as a result of the stretching and tensioning of the film wrap accomplished by tensioning means 46, the application of the stretched and tensioned film wrap and the resilient nature of the film wrap, all as described above.

In order to take up any small amount of slack in the subsequent curtain 34, established by the formation of seam 40 at the same time that seam 60 is formed to complete sleeve 62, and to enable that curtain 34 to be supported by the curtain support means provided by idler rollers 108, across the path of travel 33 and at the appropriate tension, motor 120 is actuated in reverse, during retraction of the jaws 56, to retract some film wrap 24 from wrapping station 32 and establish the appropriate tension. Such an appropriate tension is attained by stretching the curtain 34 across the path of travel 33 at wrapping station 32. The amount of stretch and, hence, the magnitude of the tension in curtain 34 is controlled by setting a specific duration for the reverse actuation of motor 120. Alternately, curtain tension can be controlled by counting the number of revolutions of a roller in the feed arrangement, by measuring the linear movement of the film wrap itself, by sensing directly the tension in the curtain, and by other means which will become apparent to those skilled in the art of automatic machines.

The above described positive control over the tension in each of the legs of sleeve 62, which legs extend along the corresponding sides 50, 52, 54 and 58 of unit load 22, enables the attainment of a closely uniform tension throughout the entire sleeve 62. Moreover, the manner in which tensioned film wrap is applied to each side 50, 52, 54 and 58 tends to preclude sliding movement of the film wrap over the corner edges lying between the sides of the unit load, thus tending to maintain better the integrity of the unit load.

Figure 10:
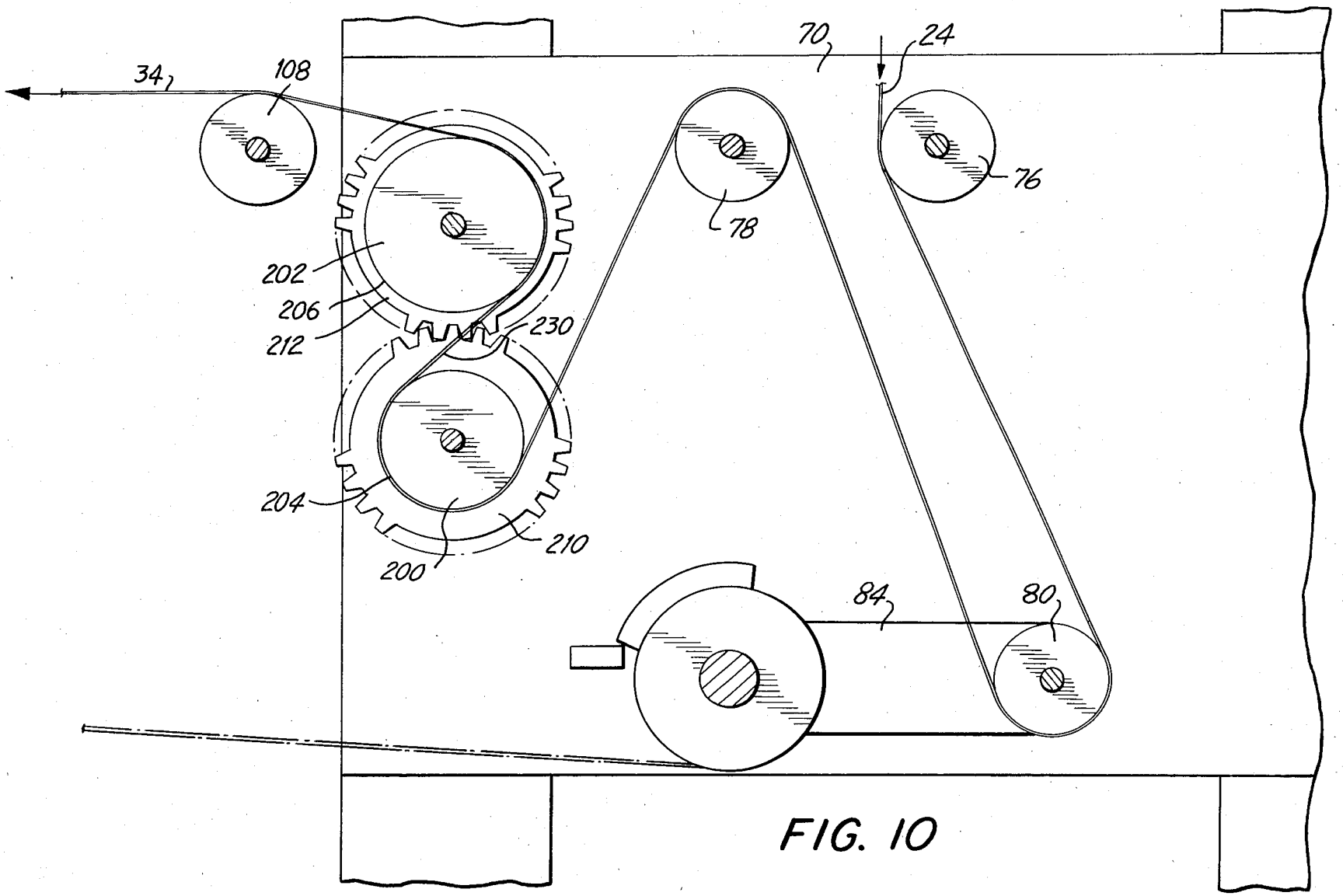
FIG. 10 is a fragmentary view similar to FIG. 8, but showing an alternate construction.

As described above, the tensioning means 46 accomplishes tensioning of the film wrap 24 independent of any forces applied to the film wrap 24 as a result of contact with the unit load 22, through stretching of the film wrap 24, which stretching results from the differential in surface speeds of serially located surfaces 104 and 106 of tension rollers 100 and 102. The differential in surface speeds is accomplished by the gear ratio of spur gears 110 and 112. However, other arrangements are available for attaining the differential in surface speeds. For example, as shown in FIG. 10, one alternate construction replaces tension rollers 100 and 102 with corresponding tension rollers 200 and 202 having outer surfaces 204 and 206, respectively. Tension rollers 200 and 202 are coupled for rotation together by spur gears 210 and 212 affixed to the lower ends of rollers 200 and 202. In this instance, the pitch diameters of spur gears 210 and 212 are equal so that rollers 200 and 202 rotate at the same speed. However, the diameters of the rollers themselves differ, with first tension roller 200 having a diameter smaller than second tension roller 202 so that the surface speed of outer surface 206 of the second tension roller 202 is greater than the surface speed of outer surface 204 of first tension roller 200. Since the film wrap 24 is coupled for movement with outer surfaces 204 and 206, the differential in surface speeds will result in the desired tensioning of the portion 230 of film wrap 24 extending between the rollers 200 and 202.

Still other modifications are possible for film wrap tensioning means 46. Thus, first and second tension rollers 100 and 102, or 200 and 202, may be coupled by a drive arrangement other than a gear train. Chain and sprocket drives, belt and pulley drives, as well as friction drives may be used. In addition, each of the first and second tension rollers may be driven by a separate motor, either electric, hydraulic or pneumatic, for operation at different speeds. Moreover, variable ratio drives, or separate motors may be used to attain selectively variable ratios so as to enable the selective adjustment of the tension placed in film wrap 24.

While in the illustrated embodiments only two serially located tension rollers are shown in each feed path 44, more than two such rollers may be employed in each set. Increasing the number of rollers will enable a more gradual change in the surface speeds from one roller to the next and, hence, a greater range of control over the tension placed in the film wrap and the rate of advancement of elongated, tensioned film wrap.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. Apparatus for wrapping a unit load at a wrapping station with a resiliently stretchable film wrap advanced along a feed path from a supply of such film wrap to the wrapping station, with the film wrap stretched and tensioned to a desired elongation and given tension, the apparatus comprising:

a first tension roller located in the feed path between the supply and the wrapping station, the first tension roller having a first surface with which the film wrap is to be coupled for movement with the first tension roller;

a second tension roller located in the feed path between the first tension roller and the wrapping station, the second tension roller having a second surface with which the film wrap is to be coupled for movement with the second tension roller;

pre-tensioning means for placing a predetermined amount of tension in a portion of the film wrap located between the supply and the first tension roller so as to couple the film wrap with the first surface of the first tension roller; and drive means for driving the tension rollers such that the surface speed of one of the first and second surfaces will be different from the surface speed of the other of the first and second surfaces by a predetermined amount so that the film wrap will be stretched and tensioned between the first and second surfaces to the desired elongation and given tension;

the pre-tensioning means including tension-applying means, mounting means mounting the tension-applying means for movement into engagement with said portion of the film wrap located between the supply and the first tension roller, biasing means associated with the tension-applying means for biasing the tension-applying means into engagement with the film wrap, and control means for controlling the biasing means such that the tension-applying means is biased into engagement with the film wrap with an essentially constant controlled biasing force to establish and maintain the predetermined amount of tension in said portion of the film wrap as the film wrap is coupled with the first surface of the first tension roller and is stretched and tensioned between the first and second surfaces of the tension rollers to the desired elongation and given tension.

2. The invention of claim 1 wherein the drive means is arranged to drive the tension rollers such that the surface speed of the second surface will be greater than the surface speed of the first surface.

3. The invention of claim 1 or 2 wherein the drive means is coupled to one of the first and second tension rollers and the invention includes coupling means coupling the first tension roller for rotation with the second tension roller.

4. The invention of claim 1 or 2 wherein the first and second surfaces have essentially equal diameters and the drive means is arranged to drive the second tension roller at a speed of rotation greater than the speed of rotation at which the first tension roller will be driven.

5. The invention of claim 4 wherein the drive means is coupled to one of the first and second tension rollers and the invention includes coupling means coupling the first tension roller for rotation with the second tension roller.

6. The invention of claim 1 or 2 wherein the second surface has a diameter greater than the first surface and the drive means will drive the first and second tension rollers at essentially equal speeds of rotation.

7. The invention of claim 6 wherein the drive means is coupled to one of the first and second tension rollers and the invention includes coupling means coupling the first tension roller for rotation with the second tension roller.

8. A wrapping machine for wrapping a resiliently stretchable film wrap around a unit load moved through the machine, with the film wrap having a desired elongation and given tension therein, the wrapping machine comprising:

a frame having an input end and an output end and defining a path of travel for the unit load as the unit load moves at a predetermined rate between the input end and the output end;

a wrapping station on the frame along the path of travel of the unit load, between the input end and the output end;

film wrap supply means including at least one film wrap supply roll located on the frame adjacent the wrapping station at each side of the path of travel of the unit load;

curtain support means for supporting a curtain of film wrap stretched across the path of travel of the unit load at the wrapping station;

feed means for advancing film wrap along a feed path from the film wrap supply rolls to the wrapping station, the feed means including a film wrap stretching and tensioning means located adjacent the wrapping station and providing a film wrap stretching and tensioning arrangement at each side of the path of travel of the unit load for stretching the film wrap as the film wrap is advanced along the feed path so as to elongate and tension the film wrap to the desired elongation and given tension;

each film wrap stretching and tensioning arrangement including a first tension roller located in the feed path between the corresponding supply roll and the wrapping station, the first tension roller having a first surface with which the film wrap is to be coupled for movement with the first tension roller;

a second tension roller located in the feed path between the first tension roller and the wrapping station, the second tension roller having a second surface with which the film wrap is to be coupled for movement with the second tension roller;

a pre-tensioning means on the frame for placing a predetermined amount of tension in a portion of the film wrap located between each supply roll and the corresponding first tension roller so as to couple the film wrap with the first surface of the first tension roller; and drive means for driving the tension rollers such that the surface speed of one of the first and second surfaces will be different from the surface speed of the other of the first and second surfaces by a predetermined amount so that the film wrap will be stretched and tensioned between the first and second surfaces to the desired elongation and given tension;

the pre-tensioning means including tension-applying means, mounting means mounting the tension-applying means for movement into engagement with said portion of the film wrap located between the supply and the first tension roller, biasing means associated with the tension-applying means for biasing the tension-applying means into engagement with the film wrap, and control means for controlling the biasing means such that the tension-applying means is biased into engagement with the film wrap with an essentially constant controlled biasing force to establish and maintain the predetermined amount of tension in said portion of the film wrap as the film wrap is coupled with the first surface of the first tension roller and is stretched and tensioned between the first and second surfaces of the tension rollers to the desired elongation and given tension.

9. The invention of claim 8 wherein the pre-tensioning means is located along the feed path between each supply roll and the corresponding first tension roller.

10. The invention of claim 8 wherein the drive means is coupled to one of the first and second tension rollers and the invention includes coupling means coupling the first tension roller for rotation with the second tension roller.

11. The invention of claim 8 wherein the first and second surfaces have essentially equal diameters and the drive means is arranged to drive the second tension roller at a speed of rotation greater than the speed of rotation at which the first tension roller is to be driven.

12. The invention of claim 11 wherein the drive means is coupled to one of the first and second tensioning rollers and the invention includes coupling means coupling the first tensioning roller for rotation with the second tensioning roller.

13. The method of wrapping a unit load at a wrapping station with a resiliently stretchable film wrap advanced along a feed path from a supply of such film wrap to the wrapping station, with the film wrap stretched and tensioned to a desired elongation and given tension, the method comprising the steps of:

passing the film wrap over a first tension roller located in the feed path between the supply and the wrapping station, the first tension roller having a first surface with which the film wrap is to be coupled for movement with the first tension roller;

thence, passing the film wrap over a second tension roller located in the feed path between the first tension roller and the wrapping station, the second tension roller having a second surface with which the film wrap is to be coupled for movement with the second tension roller;

placing a predetermined amount of tension in a portion of the film wrap located between the supply and the first tension roller to couple the film wrap with the first surface of the first tension roller; and driving the tension rollers such that the surface speed of one of the first and second surfaces will be different from the surface speed of the other of the first and second surfaces by a predetermined amount so that the film wrap will be stretched and tensioned between the first and second surfaces to the desired elongation and given tension;

the step of placing a predetermined amount of tension in the portion of the film wrap located between the supply and the first tension roller including moving a tension-applying means into engagement with said portion of the film wrap with an essentially constant biasing force and controlling the biasing force so as to establish and maintain the predetermined amount of tension in said portion of the film wrap as the film wrap is stretched and tensioned between the first and second surfaces of the tension rollers to the desired elongation and given tension.

* * * * *